US005291636A

United States Patent [19]

Knight

[11] Patent Number: 5,291,636

[45] Date of Patent: Mar. 8, 1994

[54] WOOL CUTTING OR SHEARING UNIT

[76] Inventor: Stephen J. Knight, 239 Peachy Road, Smithfield Plains, State of South Australia, Australia

[21] Appl. No.: 809,553

[22] PCT Filed: Aug. 1, 1990

[86] PCT No.: PCT/AU90/00319

§ 371 Date: Jan. 23, 1992

§ 102(e) Date: Jan. 23, 1992

[87] PCT Pub. No.: WO91/02093

PCT Pub. Date: Feb. 21, 1991

[30] Foreign Application Priority Data

Aug. 2, 1989 [AU] Australia ..... PJ5588

[51] Int. Cl.[5] ..... D01C 3/00

[52] U.S. Cl. ..... 19/2; 452/71

[58] Field of Search ..... 19/2; 83/170, 171, 915; 30/140; 452/71-73, 127; 219/221

[56] References Cited

U.S. PATENT DOCUMENTS 1,470,714 10/1923 Donner .
2,143,422 1/1939 Plass .
3,535,744 10/1970 Reise ..... 19/2

FOREIGN PATENT DOCUMENTS 233663 5/1961 Australia .
2601561 1/1988 France ..... 452/71
1214413 2/1986 U.S.S.R. ..... 30/140
1214413A 2/1986 U.S.S.R. .

*Primary Examiner*—Clifford D. Crowder
*Assistant Examiner*—Michael A. Neas
*Attorney, Agent, or Firm*—Kinzer, Plyer, Dorn, McEachran & Jambor

[57] ABSTRACT

An apparatus and method for removing or cutting wool from a skin, the apparatus comprising a conveyor to move the skin to a heated cutter element. The cutter element comprises a plurality of individually supported and heated electrical wires, and means are provided for reciprocating the cutter element. Each heated electrical wire may be individually controlled so that the wire is maintained at the cutting temperature while cutting, and will not overheat when not cutting. The cutting element is reciprocated so that the wire cutting the edge of the skin will not have one portion cutting and the other portion not overheated.

10 Claims, 3 Drawing Sheets

WOOL CUTTING OR SHEARING UNIT

This invention relates to a method and apparatus for the cutting or shearing of wool from skins and hides, particularly after the skin or pelt has been removed from the animal as for example at an abattoir.

BACKGROUND OF THE INVENTION

When animals are slaughtered, for example sheep, unless the sheep has been recently shorn, there is often a large quantity of wool on the skin and if the skin is to be tanned and produced into leather, then this wool must be removed. As the tanning is not usually carried out at or near the abattoirs, then this wool on the skin increases the transport costs, particularly as quite often the tanning and leather production is often carried out in an overseas country.

DESCRIPTION OF THE PRIOR ART

Various attempts have been made to shear the wool from a sheep or to remove the wool from the skin and these include AU 233663 which discloses an endless cutting blade to cut the wool from a skin passed under the endless cutting blade, and AU 266461 which utilizes very high pressure fluid jets to lift the wool from the skin. Another specification AU 483, 462 teaches the use of a laser to remove the wool from the skin by focusing two inclined laser bearing to intersect at the cutting area. A further specification SU 1214-413-A shows a hand held tool in the form of a handle, a forked shaped cutting head and a cutting element in the form of a wire connected to an electrical supply attached to the tips of the fork. Control means regulate the heating of the wire and the wire tension is also controlled.

However it appears that none of the above have been entirely successful and it is an object of this invention to provide an improved method and apparatus for the removal of wool or hair from the skin of an animal, and although the following description is particularly directed to the removal of wool from the skin of a slaughtered animal, it is to be realized that the invention is not to be limited thereto.

BRIEF DESCRIPTION OF THE INVENTION

There is provided according to the invention the method of removal of wool from the skin, the method including the steps of presenting the skin with the wool thereon to a cutting element, said cutting element comprising a heated electrical element, and including the step of providing relative movement of the cutting element in a direction transverse to the direction of motion of the skin toward the cutting element.

Also in accordance with the present invention there is provided an apparatus for the removal of wool from a sheep skin, the apparatus including conveyor means to present the skin to a cutting element, said cutting element comprising a heated electrical element, means for heating the element, and means for providing relative movement of the cutting element in a direction transverse to the direction of the motion of the skin toward the cutting element.

BRIEF DESCRIPTION OF THE DRAWINGS

In order to more fully describe the invention reference will now be made to the accompanying drawings in which.

DESCRIPTION OF THE PREFERRED EMBODIMENT

Figure 1:
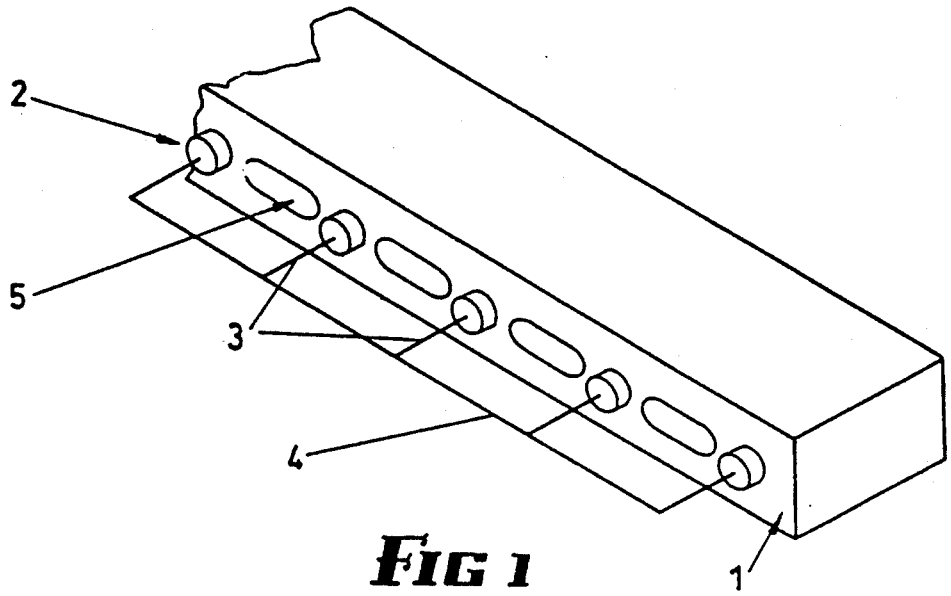
FIG. 1 is a diagrammatic illustration of one form of the cutting element.

Referring firstly to FIG. 1 there is shown the cutter bar 1 provided with a plurality of spaced collets 2 each having a support 3 for a cutting wire 4 bridging all the supports 3. The cutting wire is supplied with electrical power to heat the wire to a temperature sufficient to burn or char the wool fibers so that the fleece of wool can be removed from the skin.

The cutter bar 1 is also provided with an air supply which air passes out of the air discharge outlets 5. This air can be used to lift the severed wool above the cutting element and onto a guide or conveyor (not shown), and if heated can also assist in the drying of the wool at the cutting area to assist in the cutting of the wool.

Figure 2:
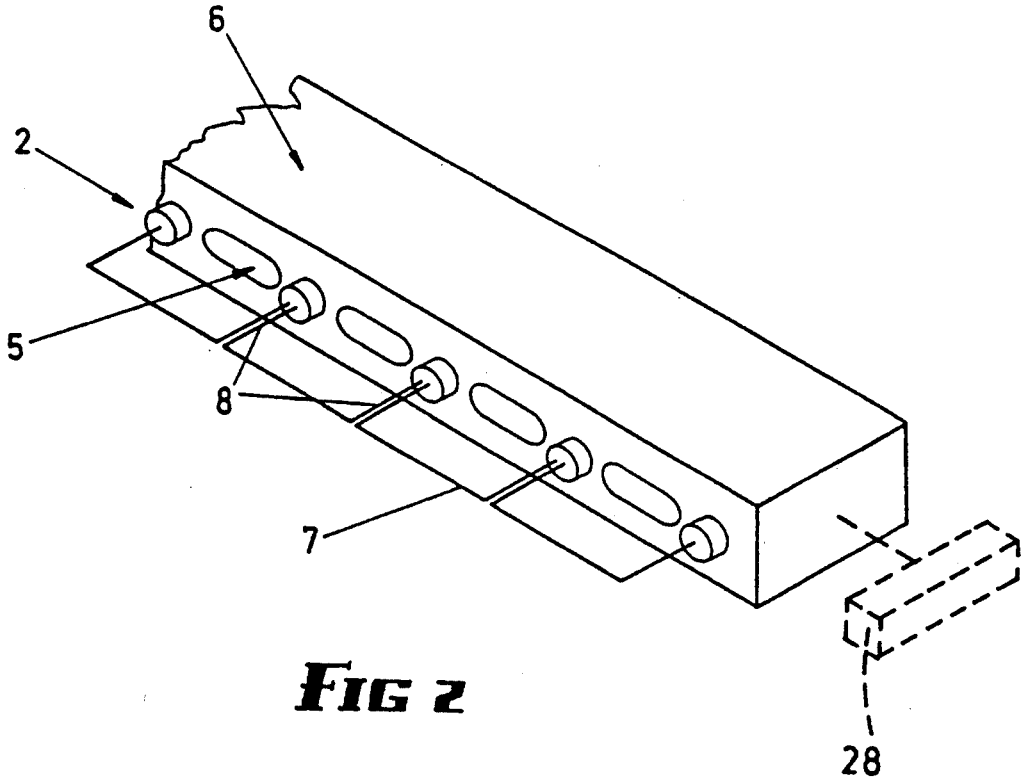
FIG. 2 is a similar view of a further form of the cutting element.

FIG. 2 shows a further cutter bar 6 also having the collets 2 and the air discharge outlets 5. However there are a plurality of cutting wires 7 mounted on wire supports 8 so that the plurality of cutting wires can be individually controlled, for example by a microprocessor 28. The current flow and thus the temperature of each individual section can be individually controlled depending on whether the wire is in contact with thick dense wool, thin belly wool or is not in contact with wool at the edges of the fleece.

Figure 3:
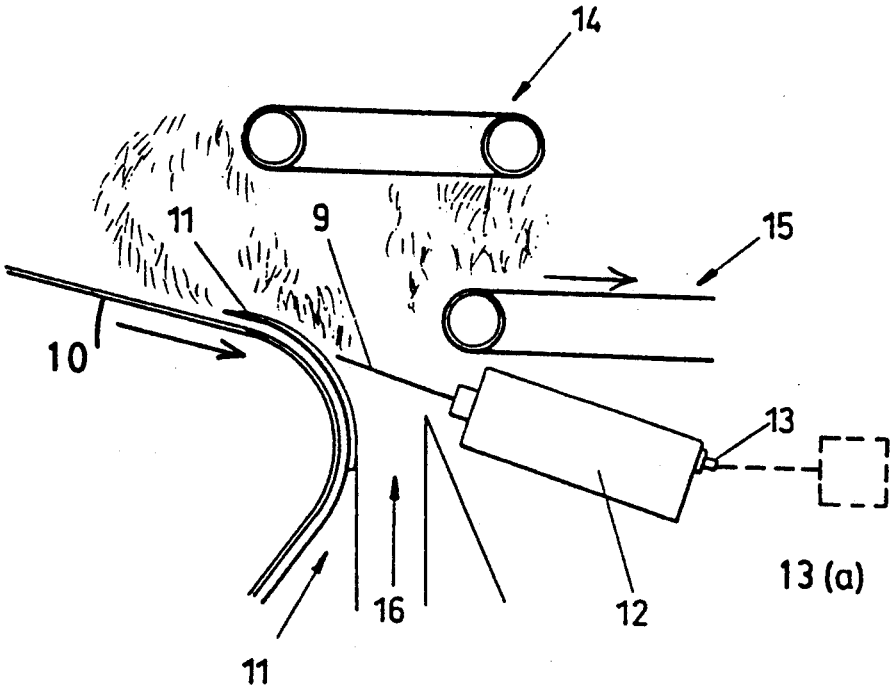
FIG. 3 is a diagrammatic view of the arrangement of the apparatus.

Turning now to FIG. 3 there is shown an arrangement of an apparatus for the cutting of the wool from a skin. The skin is presented to the cutter 9 by a conveyor 10, a comb 11 being positioned adjacent the conveyor 10 so that the skin passes beneath the comb 11, the fingers of the comb 11 passing through the wool and the cutter 9 being positioned adjacent the comb. The cutter 9 is mounted on the cutter bar 12 having the electrical connection 13 for the supply of electrical power to the cutter 9 which is provided by an electrical supply means 13*a*.

A conveyor 14 is diagrammatically shown to assist in the feeding of the skin to the cutter and a conveyor 15 removes the cut wool or fleece from the skin, the skin itself passing downwardly between the comb and the conveyor 10. Between the conveyor and the cutter bar there is an air supply 16 which assists in lifting the cut wool from the conveyor 10 to the conveyor 15.

Figure 4:
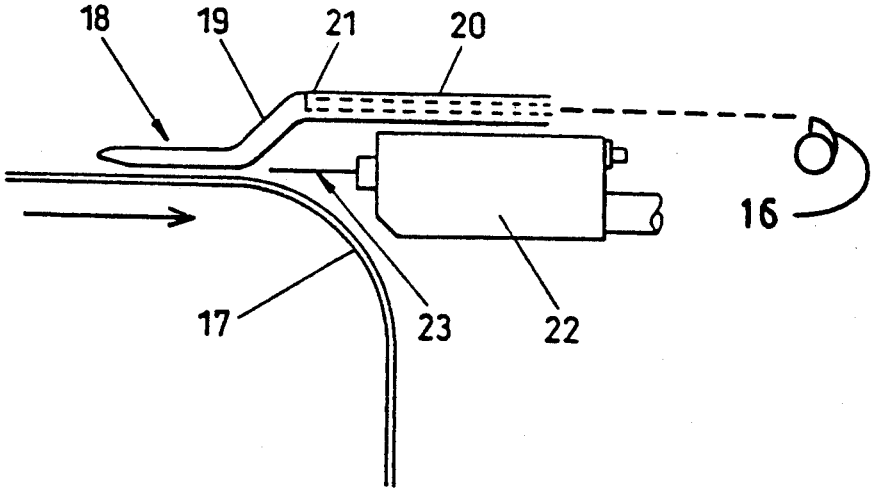
FIG. 4 is a view of the cutter and comb.

FIG. 4 shows a further form of the invention having a conveyor 17, a comb 18 being spaced slightly above the conveyor 17, the comb fingers having an upwardly sloping portion 19 joining to a horizontal portion 20 and an air supply 16. The rear portion 20 of the fingers is hollow so that air can pass therethrough and out an air discharge outlet 21 to assist in lifting the wool onto a discharge conveyor. The cutter bar 22 has the cutter 23 mounted thereon and also connections for the air and electrical supplies.

Figure 5:
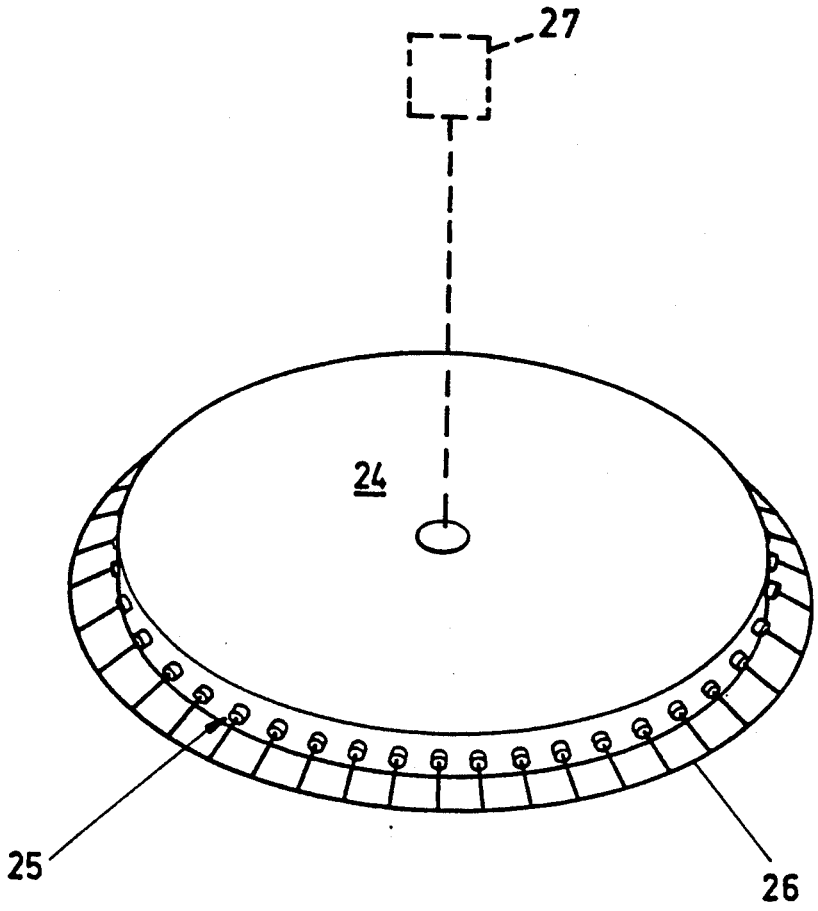
FIG. 5 shows a further form of the invention.

A still further form of the invention is shown in FIG. 5 in which the cutter bar 24 is circular with a peripheral array of collets 25 supporting a peripheral cutting wire, the circular cutter bar being connected to a rotating means 27 for rotating said circular cutter bars 24 to provide relative motion between the cutting wire and the wool.

In all of the above examples in FIGS. 1 to 4 means are provided to reciprocate the cutter bar and thus the cutting wire in a direction transverse to the motion of the skin to the cutter. Thus the cutter can have a stroke of 20 to 200 millimeters, but preferable the stroke is in the range of 50 to 150 millimeters preferably 100 millimeters. The frequency of the reciprocatory motion could be in the range of 50 to 250 cycles per minute, but preferably is in the order of 150 cycles per minute.

The temperature of the wire cutter is preferably controlled by a microprocessor so that there is instant detection and control of the temperature of the wire, not only to provide adequate heat for the cutting of the wool, but also ensure that the wire does not become overheated and fuse.

The temperature of the wire is also controlled by the reciprocation of the cutter bar, so that in this way the wire will be passing into and out of the denser portions of the wool on the skin, and also in and out of the lesser dense portions of the wool, so that one portion of the wire cuter is not continuously in a denser portion of the wool, while another portion of the wire is in very light wool where it would become overheated.

It will be realised that the fingers of the comb could also vibrate and oscillate and this will greatly assist in the penetration of the fingers into the wool. Also there may be air jets in these fingers to assist in the drying of the wool phor to the wool passing to the cutter.

Although various forms of the invention have been described in some detail, it is to be realised that the invention is not to be limited thereto, but can include variations failing with the spirit and scope of the invention.

I claim:

1. A method of removal of wool from skin, said method including the steps of providing a cutting element comprising a plurality of wires supported on a reciprocal bar, providing a means for supplying electric current to said cutting element wires, presenting the skin to said cutting element, providing relative movement of the bar in a direction transverse to the direction of motion of the skin toward the cutting element and providing a flow of air to lift the cut wool away from the skin during the cutting step and onto a discharge conveyor.

2. The method as defined in claim 1 including the step of reciprocating the cutting element transfers to the direction of movement of the skin and parallel to the surface of the skin.

3. Apparatus for the removal of wool from a skin, said apparatus comprising conveyor means to present the skin to abutting element, said cutting element comprising a plurality of individually heated electrical elements, means or supplying electrical current to the electrical elements, and means for providing movement of the cutting element relative to the skin in a direction transverse to the relative movement of the skin to the cutting element and parallel to the skin.

4. Apparatus as defined in claim 3, characterized in that the electrical elements comprise wires supported on fingers attached to collets supported by a cutting bar on said cutting element.

5. Apparatus as defined in claim 4 characterized by a conveyor to move and present the skin to the cutting element, a comb positioned adjacent the conveyor to pass through the wool, the cutting element being positioned adjacent the comb so that the skin, after the wool has been removed therefrom, is passed by the conveyor under the comb.

6. Apparatus as defined in claim 3 characterized by air supply means to lift the cut wool from the skin so passed to a discharge conveyor.

7. Apparatus as defined in claim 6 characterized in that the air issues from jets in hollow fingers on a comb, as the comb is passed through the wool adjacent the cutting element.

8. Apparatus as defined in claim 6 characterized by air outlets in said bar adjacent said cutting element to lift the wool toward a discharge position.

9. Apparatus according to claim 3 characterized by a means or separately controlling electrical current to each one of the plurality of electrical elements.

10. Apparatus for the removal of wool from a skin, said apparatus comprising conveyor means to present the skin to a cutting element, said cutting element comprising a plurality of individually heated electrical elements, each electrical element comprising an electrical wire supported on a pair of fingers attached to a cutting bar, means for heating each electrical element, and means for providing movement o the cutting element relative to the skin in a direction transverse o the movement of the skin to the cutting element and parallel to the skin, characterized in that there is provided a means for separately controlling electrical current to each one of the plurality of electrically heated elements.

* * * * *